US010246652B2

(12) United States Patent
Chouan et al.

(10) Patent No.: US 10,246,652 B2
(45) Date of Patent: Apr. 2, 2019

(54) PROCESS FOR THE DEAROMATIZATION OF PETROLEUM CUTS

(71) Applicant: TOTAL MARKETING SERVICES, Puteaux (FR)

(72) Inventors: Xavier Chouan, Suresnes (FR); Patrick Vedrine, Houilles (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 15/107,360

(22) PCT Filed: Dec. 15, 2014

(86) PCT No.: PCT/EP2014/077744
§ 371 (c)(1),
(2) Date: Jun. 22, 2016

(87) PCT Pub. No.: WO2015/097009
PCT Pub. Date: Jul. 2, 2015

(65) Prior Publication Data

US 2016/0369182 A1 Dec. 22, 2016

(30) Foreign Application Priority Data

Dec. 23, 2013 (FR) ..... 13 63388

(51) Int. Cl.
*C10G 65/08* (2006.01)
*C10G 45/44* (2006.01)

(52) U.S. Cl.
CPC ..... *C10G 65/08* (2013.01); *C10G 45/44* (2013.01); *C10G 2300/4031* (2013.01); *C10G 2300/70* (2013.01)

(58) Field of Classification Search
CPC ..... C10G 65/08; C10G 45/44; C10G 45/72; C10G 65/02; C10G 65/04
See application file for complete search history.

(56) References Cited

U.S. PATENT DOCUMENTS

| | | | |
|---|---|---|---|
| 3,654,139 A | 4/1972 | Winsor et al. | |
| 3,755,143 A | 8/1973 | Hosoi et al. | |
| 3,767,562 A | 10/1973 | Sze et al. | |
| 4,036,734 A | 7/1977 | Manne et al. | |
| 4,347,124 A | 8/1982 | Shimoiizaka et al. | |
| 4,447,315 A | 5/1984 | Lamb et al. | |
| 4,469,590 A | 9/1984 | Schucker et al. | |

(Continued)

FOREIGN PATENT DOCUMENTS

| | | | |
|---|---|---|---|
| EP | 0026508 A1 * | 4/1981 | ..... C10G 45/02 |
| EP | 1447437 A1 | 8/2004 | |

(Continued)

*Primary Examiner* — Michelle Stein
(74) *Attorney, Agent, or Firm* — Harness, Dickey & Pierce, PLC

(57) ABSTRACT

A process for the continuous dearomatization of a petroleum cut to produce a hydrocarbon-containing fluid with a very low sulphur content and very low aromatic compounds content, includes at least one stage of catalytic hydrogenation at a temperature between 80 and 180° C. and at a pressure between 50 and 160 bar. The stage of catalytic hydrogenation of the dearomatization process comprises several interchangeable reactors linked in series.

12 Claims, 6 Drawing Sheets fixed additional connections after the changing of the catalyst of R1

Configuration R2-> R1-> R3

(56) References Cited

U.S. PATENT DOCUMENTS

| | | | |
|---|---|---|---|
| 4,601,814 | A | 7/1986 | Mauleon et al. |
| 4,816,137 | A | 3/1989 | Swint et al. |
| 4,875,992 | A | 10/1989 | Hamner |
| 5,114,562 | A | 5/1992 | Haun et al. |
| 5,498,810 | A | 3/1996 | Bogdan et al. |
| 5,654,253 | A | 8/1997 | Hucul et al. |
| 5,925,234 | A | 7/1999 | Morel et al. |
| 5,954,941 | A | 9/1999 | Mercier et al. |
| 6,217,749 | B1 | 4/2001 | Espeillac et al. |
| 6,416,657 | B1 | 7/2002 | Fersing et al. |
| 6,679,986 | B1 | 1/2004 | Da Silva et al. |
| 6,767,451 | B2 | 7/2004 | Espeillac et al. |
| 6,869,576 | B2 | 3/2005 | Espeillac et al. |
| 6,881,385 | B2 | 4/2005 | Fersing et al. |
| 7,056,869 | B2 | 6/2006 | Guyomar et al. |
| 7,071,150 | B2 | 7/2006 | Genuyt et al. |
| 7,087,155 | B1 | 8/2006 | Dath et al. |
| 7,311,814 | B2 | 12/2007 | Guyomar et al. |
| 7,544,333 | B2 | 6/2009 | Espeillac et al. |
| 7,686,945 | B2 | 3/2010 | Benard et al. |
| 8,163,171 | B2 | 4/2012 | Gribschaw et al. |
| 8,624,071 | B2 | 1/2014 | Vermeiren et al. |
| 8,889,933 | B2 | 11/2014 | Vermeiren et al. |
| 9,045,814 | B2 | 6/2015 | Gotteland et al. |
| 9,174,202 | B2 | 11/2015 | Marchand et al. |
| 9,233,359 | B2 | 1/2016 | Borremans et al. |
| 9,233,363 | B2 | 1/2016 | Borremans et al. |
| 9,255,229 | B2 | 2/2016 | Borremans et al. |
| 9,260,355 | B2 | 2/2016 | Vermeiren et al. |
| 9,315,742 | B2 | 4/2016 | Aubry et al. |
| 2001/0001036 | A1 | 5/2001 | Espeillac et al. |
| 2002/0096452 | A1 | 7/2002 | Espeillac et al. |
| 2002/0139712 | A1 | 10/2002 | Fersing et al. |
| 2004/0211704 | A1 | 10/2004 | Espeillac et al. |
| 2006/0161031 | A1 | 7/2006 | Gribschaw et al. |
| 2007/0131588 | A1 | 6/2007 | Vermeiren et al. |
| 2010/0087692 | A1 | 4/2010 | Yoshimura et al. |
| 2012/0142983 | A1 | 6/2012 | Vermeiren et al. |
| 2012/0283492 | A1* | 11/2012 | Dalemat ..... C10G 45/48 585/16 |
| 2013/0001127 | A1 | 1/2013 | Aubry et al. |
| 2013/0008829 | A1 | 1/2013 | Marchand et al. |
| 2013/0035533 | A1 | 2/2013 | Hedhli et al. |
| 2013/0150232 | A1 | 6/2013 | Gotteland et al. |
| 2013/0150637 | A1 | 6/2013 | Borremans et al. |
| 2013/0165711 | A1 | 6/2013 | Dandeu et al. |
| 2013/0172638 | A1 | 7/2013 | Borremans et al. |
| 2013/0193035 | A1 | 8/2013 | Borremans et al. |
| 2013/0211733 | A1 | 8/2013 | Baeveghems et al. |
| 2013/0245348 | A1 | 9/2013 | Vermeiren et al. |
| 2013/0267742 | A1 | 10/2013 | Minoux et al. |
| 2013/0319908 | A1 | 12/2013 | Halais et al. |
| 2013/0319911 | A1 | 12/2013 | Halais et al. |
| 2013/0327682 | A1 | 12/2013 | Halais et al. |
| 2014/0114105 | A1 | 4/2014 | Vermeiren et al. |
| 2014/0329939 | A1 | 11/2014 | Iliopoulos et al. |

FOREIGN PATENT DOCUMENTS

| | | | |
|---|---|---|---|
| EP | 1619232 | A1 | 1/2006 |
| FR | 2950072 | A1 | 3/2011 |
| GB | 834776 | A | 5/1960 |
| GB | 1218920 | A | 1/1971 |
| GB | 1282774 | A | 7/1972 |
| GB | 1457861 | A | 12/1976 |
| GB | 1471228 | A | 4/1977 |
| WO | WO-99/47626 | A1 | 9/1999 |

* cited by examiner

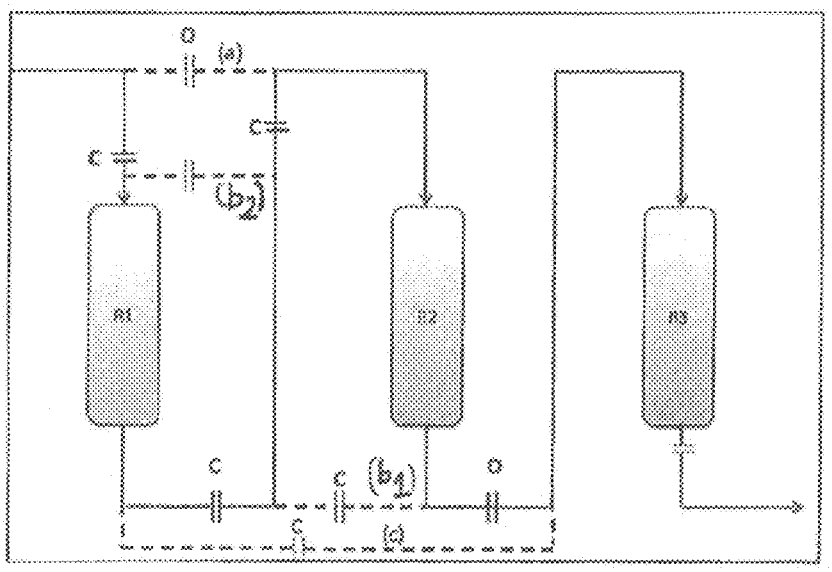
O: open, C: closed
Figure 1: fixed additional connections during the changing of the catalyst of R1.
Configuration R2-> R3
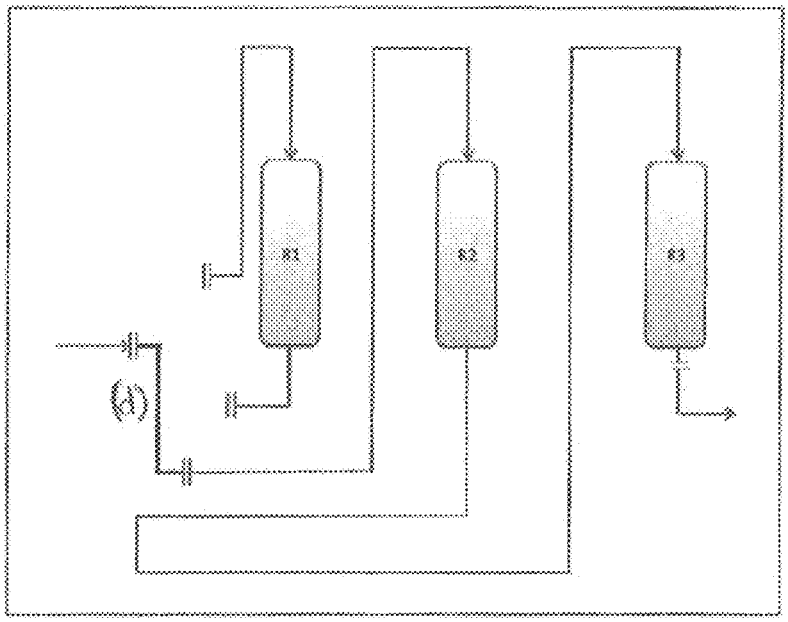
Figure 2: removable additional connections during the changing of the catalyst of R1.
Configuration R2-> R3

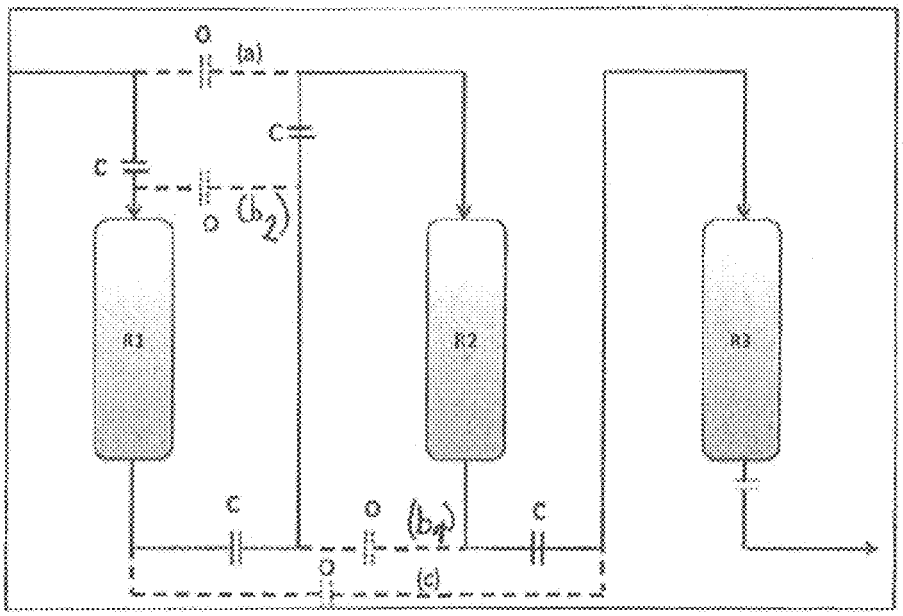
Figure 3: fixed additional connections after the changing of the catalyst of R1.
Configuration R2-> R1-> R3
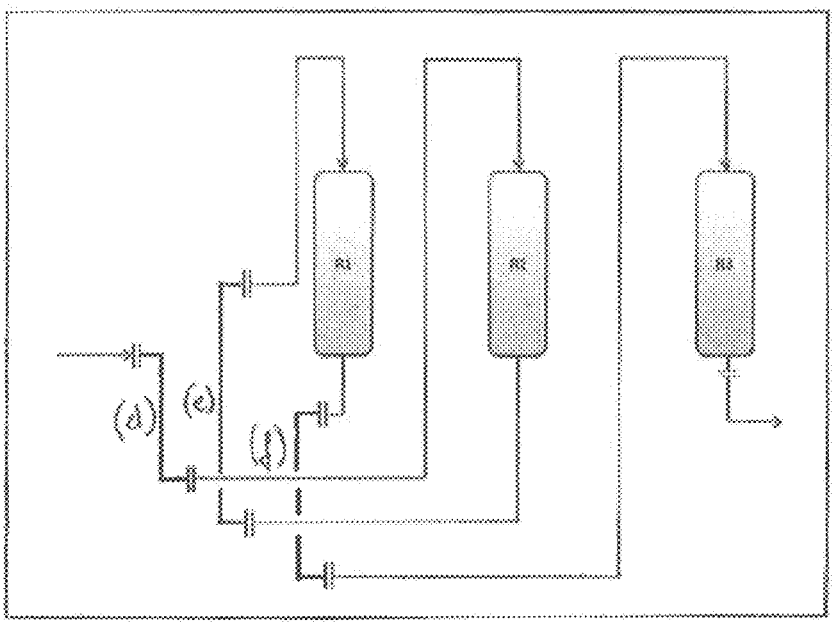
Figure 4: removable additional connections after the changing of the catalyst of R1
Configuration R2-> R1-> R3

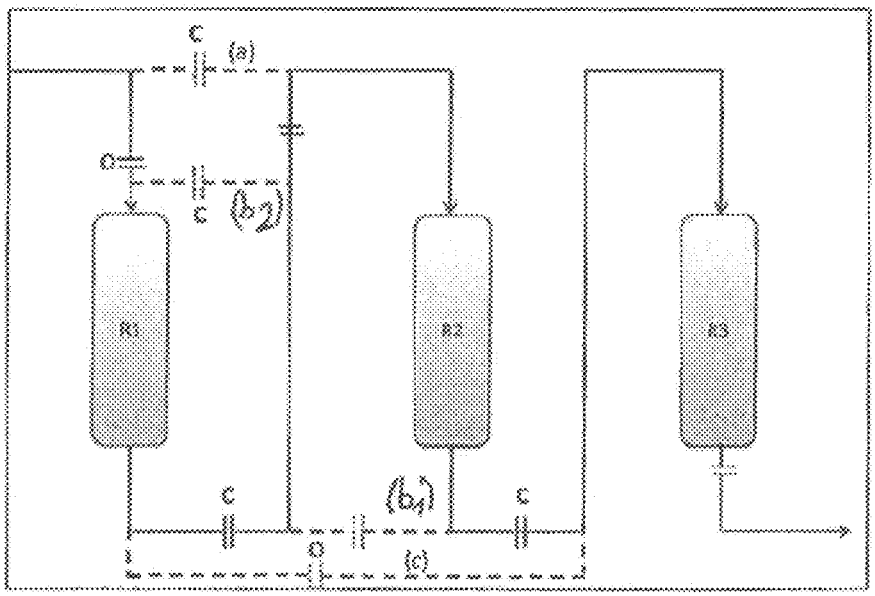
Figure 5: fixed additional connections during the changing of the catalyst of R2
Configuration R1-> R3
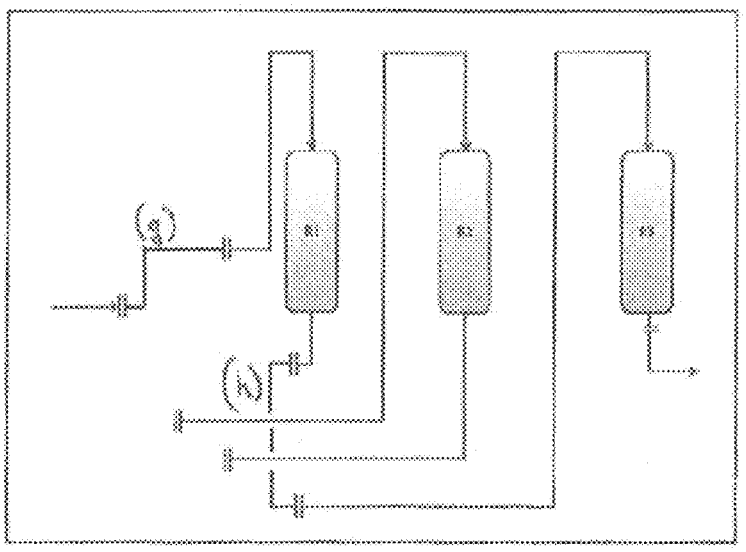
Figure 6: removable additional connections during the changing of the catalyst of R2
Configuration R1-> R3

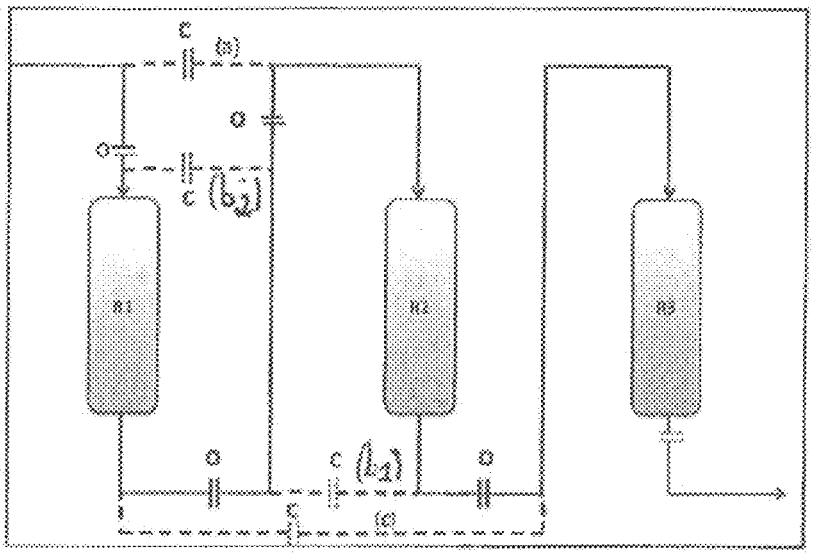
Figure 7: fixed additional connections after the changing of the catalyst of R2
Configuration R1-> R2-> R3
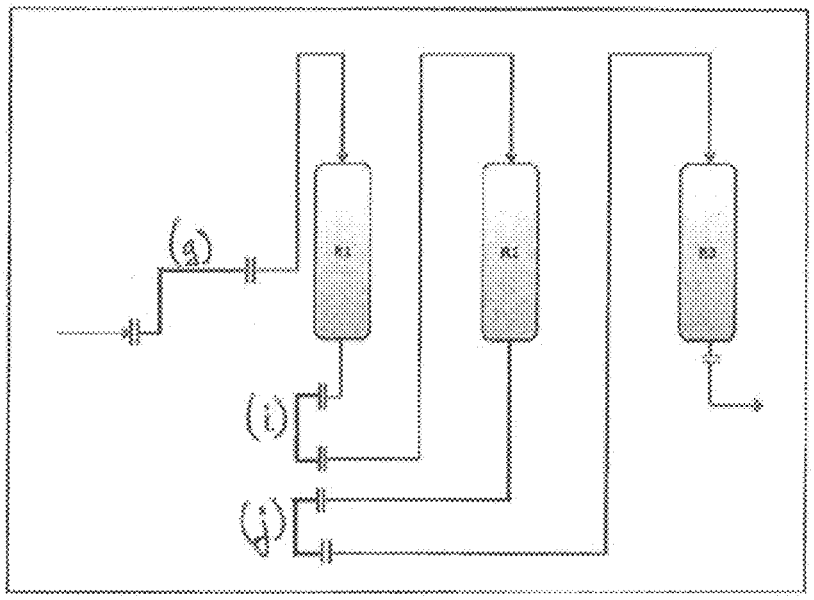
Figure 8: removable additional connections after the changing of the catalyst of R2
Configuration R1-> R2-> R3

PROCESS FOR THE DEAROMATIZATION OF PETROLEUM CUTS

CROSS-REFERENCE TO RELATED APPLICATIONS

This application is a National Phase Entry of International Patent Application No. PCT/EP2014/077744, filed on Dec. 15, 2014, which claims priority to French Patent Application Serial No. 13 63 388, filed on Dec. 23, 2013, both of which are incorporated by reference herein.

TECHNICAL FIELD

The invention relates to a process for the continuous dearomatization of a petroleum cut to produce a hydrocarbon-containing fluid with a very low sulphur content and very low aromatic compounds content, comprising at least one stage of catalytic hydrogenation at a temperature comprised between 80 and 180° C. and at a pressure comprised between 50 and 160 bar. In particular the invention relates to a process for the deep dearomatization of a petroleum cut in which the stage of catalytic hydrogenation comprises several interchangeable reactors linked in series.

BACKGROUND

Hydrocarbon-containing fluids are widely used as solvents, for example in adhesives, cleaning liquids, explosives, solvents for decorative coatings, paints and printing inks, light oils used in applications such as metal extraction, metal working or mould release, industrial lubricants and drilling fluids. Hydrocarbon-containing fluids can also be used as dilution oils in adhesives and sealing systems such as silicone mastics, as viscosity reducers in formulations based on plasticized polyvinyl chloride, as solvents in polymer formulations serving as flocculants, for example in water treatment, mining operations or paper manufacture and also as thickeners in printing pastes. Hydrocarbon-containing fluids can moreover be used as solvents in a very wide range of other applications, for example in chemical reactions.

In order to produce these hydrocarbon-containing fluids, the petroleum cuts used as feedstocks are treated in hydrodearomatization units by a process of catalytic hydrogenation composed of several reactors in series operated at high pressure. These reactors have one or more catalytic beds. The units are composed of main treatment sections which are generally: the feedstock storage unit, the hydrogenation section with several reactors, the distillates separation section and the distillation column (see FIG. 10).

The configuration generally put in place for the hydrogenation section is a sequence of several reactors in series. The efficiency of the hydrodearomatization by hydrogenation unit is dependent on several parameters and particularly on the level of catalytic activity of the first reactor used as a sulphur trap. This activity decreases with time until it becomes zero after a complete period of use. The catalytic activity depends on the quantity of sulphur supplied to the surface of the catalyst by the feedstocks to be treated. The quantity of sulphur captured by the catalyst of the first reactor is directly proportional to the sulphur concentration of the petroleum feedstock. Thus very little sulphur arrives at the second and third reactor in the series.

Sulphur is a poison to the catalyst necessary for the dearomatization reaction, and the aromatic compounds must be hydrogenated in order to obtain high-purity products. The catalyst of the first reactor used as a sulphur trap is therefore rapidly saturated by the quantity of sulphur supplied with the feedstocks to be treated. It is then necessary to change the catalyst of this first reactor. Furthermore, in order to avoid a spillover of sulphur into the second reactor, the catalyst of the first reactor will be changed at a maximum saturation of 90% and not 100%, thus resulting in reduced profitability. By contrast, as the second and third reactors receive only a little sulphur; their catalyst will be replaced only after longer cycles of treatment which may last up to several years. Current configurations of the hydrodearomatization units require a complete shutdown of the entire unit in order to change the catalyst, even if only the reactor 1 is involved. This complete shutdown of the units involves a considerable loss of production, as the shutdown may last several days.

An objective of the application is to provide an improved dearomatization process for the continuous preparation of hydrocarbon-containing fluids. Another objective of the invention is to provide a system for the optimized treatment of petroleum feedstocks allowing a reduction in production losses and flexibility of operability. The invention also has the objective of allowing complete saturation of the hydrogenation catalysts of the hydrodearomatization process before unloading.

SUMMARY

The invention relates to a process for the continuous dearomatization of a petroleum cut to produce a hydrocarbon-containing fluid with a very low sulphur content and very low aromatic compounds content comprising at least one stage of catalytic hydrogenation at a temperature comprised between 80 and 180° C. and at a pressure comprised between 60 and 160 bar, said stage of hydrogenation comprises several interchangeable reactors, i.e. the order of which can be reversed, linked in series. Preferably, the process according to the invention comprises 3 reactors linked in series. The first and second reactors of the process according to the invention can be isolated from the other reactors in turn. The process according to the invention allows the catalysts of the first and second reactors to be changed without prolonged interruption of the production.

According to an embodiment, the reactors in series of the process according to the invention are linked by fixed additional connections making it possible to isolate one of the reactors. According to a second embodiment, the reactors in series of the process according to the invention are linked by removable additional connections making it possible to isolate one of the reactors.

The reactors in series of the process according to the invention comprise catalysts. Said catalysts are changed at 100% saturation. The process according to the invention allows a hydrogenation rate comprised between 50 and 300 $Nm^3$/tonne of feedstock. The quantity by weight of catalyst in each of the 3 reactors linked in series of the process according to the invention is respectively 0.05-0.5/0.10-0.70/0.25-0.85. Preferably the quantity by weight of catalyst in each of the 3 reactors linked in series of the process according to the invention is 0.07-0.25/0.15-0.35/0.4-0.78 and more preferentially 0.10-0.20/0.20-0.32/0.48-0.70.

According to an embodiment, the process according to the invention comprises the steps of:

a) isolation of one of the reactors, b) feeding one of the two non isolated reactors with the petroleum cut and feeding the second non isolated reactor with effluent from the first non isolated reactor, c) regeneration of the isolated reactor by replacement of the catalyst, d) feeding the regenerated reactor with the effluent from the first of the two non isolated reactors of stage b) and feeding the second non-isolated reactor of stage b) with the effluent from the regenerated reactor.

According to an embodiment, the process according to the invention comprises the stages of:

isolation of the first reactor in series, feeding the second reactor in series with the petroleum cut and feeding the third reactor in series with the effluent from the second reactor, replacement of the catalyst of the first reactor, feeding the first reactor with the effluent from the second reactor and feeding the third reactor with the effluent from the first reactor.

According to an embodiment, the process according to the invention comprises the stages of:

isolation of the second reactor in series, feeding the first reactor in series with the petroleum cut and feeding the third reactor in series with the effluent from the first reactor, replacement of the catalyst of the second reactor, feeding the second reactor with the effluent from the first reactor and feeding the third reactor with the effluent from the second reactor.

BRIEF DESCRIPTION OF THE DRAWINGS

FIGS. 1 to 8 are diagrammatic representations of the optimized dearomatization unit according to the invention.

DETAILED DESCRIPTION

Figure 9:
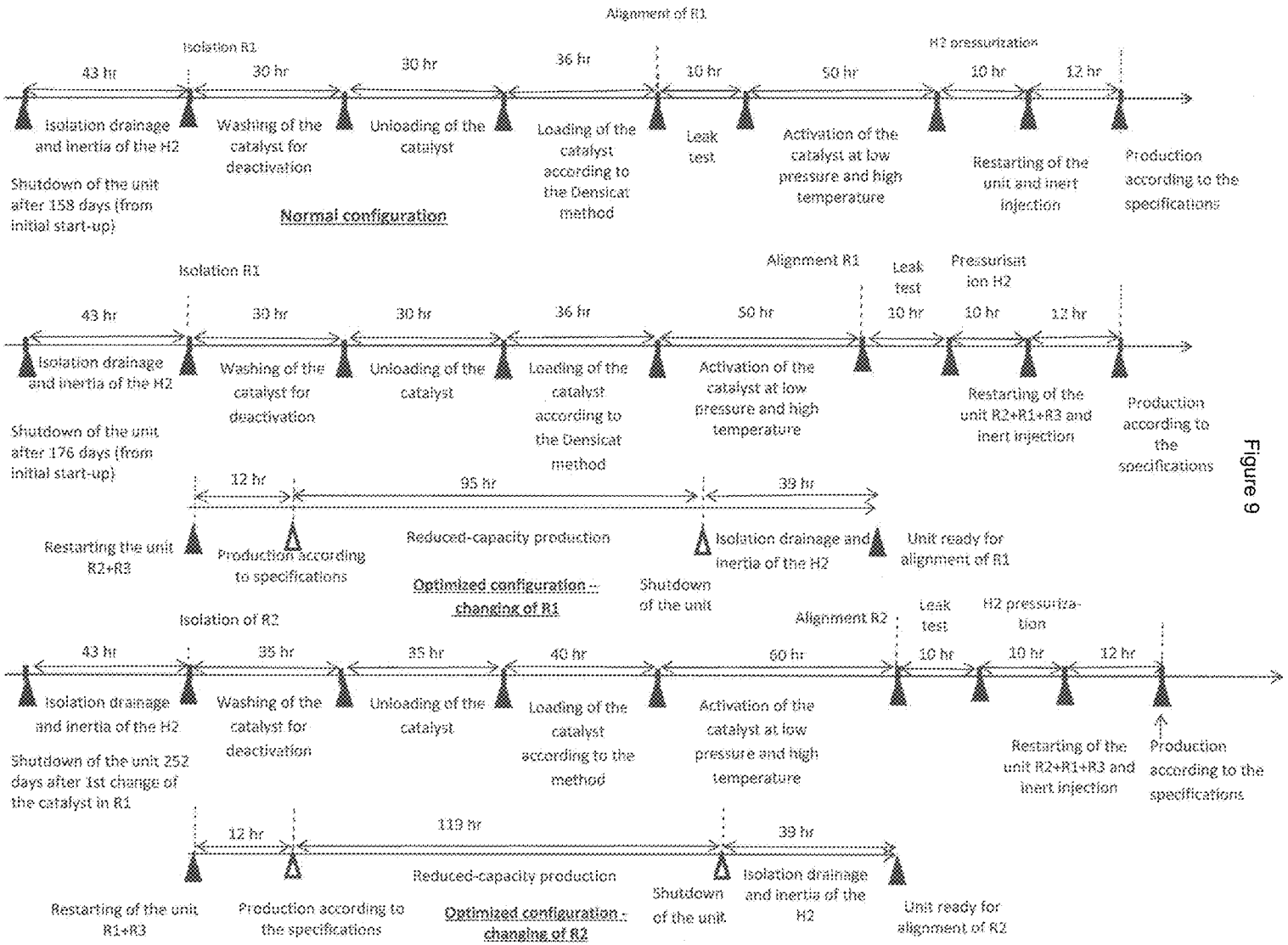
FIG. 9 is a comparison between a normal system of hydrogenation reactors in series and the optimized system according to the invention during the changing of the catalyst of reactor R1 then of the catalyst of reactor R2.
Figure 10:
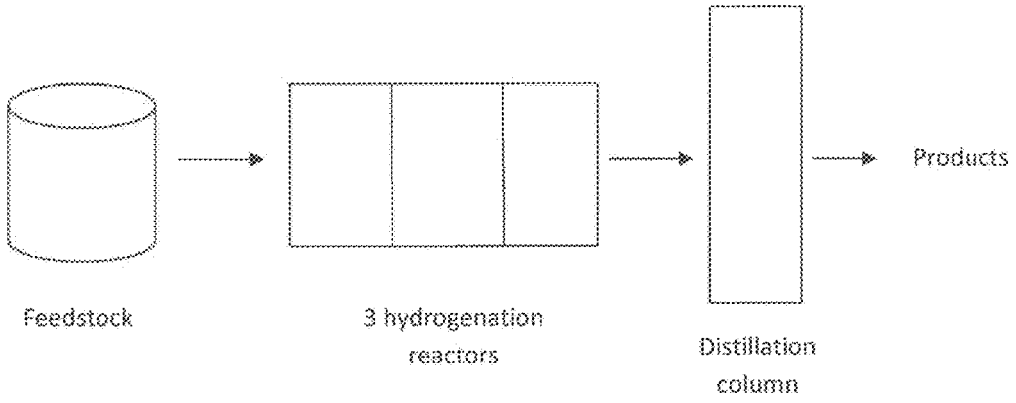
FIG. 10 shows a general diagram of a conventional dearomatization process.

The process according to the invention relates to an improvement of the operating conditions of the hydrogenation reactors of a dearomatization unit allowing the production of hydrocarbon-containing fluids. A stage of prefractionation of the petroleum cut can optionally be carried out before the introduction of the cut into the hydrogenation unit. The petroleum cuts optionally prefractionated are then hydrogenated. The hydrogen which is used in the hydrogenation unit is typically a high-purity hydrogen, the purity of which, for example, exceeds 99%, but other levels of purity can also be used. The hydrogenation takes place in one or more reactors in series. The reactors can comprise one or more catalytic beds. The catalytic beds are generally fixed catalytic beds.

The process of the present invention preferably comprises two or three reactors, preferably three reactors and is more preferentially carried out in three separate reactors. The first reactor involves trapping the sulphur, allowing the hydrogenation of essentially all the unsaturated compounds and up to approximately 90% of the aromatic compounds. The flow leaving the first reactor essentially contains no sulphur. At the second stage i.e. in the second reactor, the hydrogenation of the aromatics continues and up to 99% of the aromatics are therefore hydrogenated. The third stage in the third reactor is a finishing stage making it possible to obtain aromatics contents less than 300 ppm, preferably less than 100 ppm and more preferentially less than 50 ppm, even in the case of products with a high boiling point.

According to the invention, the sequence of the reactors is configured so as to allow continuous operation of the unit and therefore a production, without prolonged interruption, of hydrocarbon-containing fluids even during the changing of the catalysts of the reactors. By prolonged interruption is meant an interruption of the unit longer than several days, preferably longer than 2 days. If there is an interruption in the process according to the invention, it will only be of the order of a few hours and always less than 2 days or even 1 day.

The process according to the invention is described with reference to the attached drawings. The hydrogenation unit comprises, according to FIG. 1, 3 reactors R1, R2 and R3 connected in series. According to an embodiment of the invention, the improved process comprises 4 additional fixed connections (a), (b1), (b2) and (c). During the changing of the catalyst of R1, reactor R2 is directly fed with the feedstock via the connection (a) without passing through reactor R1. During the changing of the catalyst of R1, reactor R2 then becomes the first reactor and is thus directly fed with the feedstock via section (a) which therefore no longer passes through reactor R1. After the changing of the catalyst of R1, reactor R2 remains the first reactor and sections (b1) and (b2) link the effluent from reactor R2 to the inlet of reactor R1 which becomes the second reactor. Section (c) makes it possible to link the effluent from reactor R1 to the inlet of reactor R3. (FIG. 3)

According to a second embodiment (FIG. 2), the hydrogenation unit according to the invention comprises removable additional connections also making it possible to maintain production during the changing of the catalyst of reactor R1. Section (d) thus makes it possible to completely isolate reactor R1 during the changing of its catalyst and thus to guarantee enhanced safety conditions. Reactor R2 will be directly fed with the feedstock without passing through reactor R1. The effluent from reactor R2 is then directed directly towards the inlet of reactor R3. Sections (e) and (f) of FIG. 4 show the sequence of the hydrogenation reactors after the changing of the catalyst of reactor R1. Reactor R2 fed with the feedstock via section (d) remains the first reactor. Section (e) then links the effluent from reactor R2 to the inlet of reactor R1 which becomes the second reactor. Section (f) makes it possible to link the effluent from reactor R1 to the inlet of reactor R3.

According to a third embodiment of the invention (FIG. 5), reactor R2 is isolated from reactors R1 and R3 during the changing of its catalyst without interrupting production. The additional fixed connections (a), (b1) and (b2) in FIG. 5 will be closed while connection (c) will be open, thus allowing a treatment of the feedstocks via reactors R1 then R3 only. Reactor R2 is thus short-circuited throughout the period of time necessary for changing its catalyst.

According to a fourth embodiment of the invention (FIG. 6), reactor R2 is isolated from reactors R1 and R3 during the changing of its catalyst without interrupting production, by connecting the additional removable connections (g) and (h) as shown in FIG. 6. The feedstock to be treated will directly feed reactor R1 via section (g) then the effluent from reactor R1 will be directed towards the inlet of reactor R3 via section (h) so as never to pass through reactor R2. Once the catalyst of reactor R2 has been renewed and activated, the optimized dearomatization process according to the third and fourth embodiments will be carried out according to FIGS. 7 and 8 by closing the additional fixed connections (a), (b1), (b2) and (c) or by means of the additional removable connections (g), (i) and (j) connected so that the feedstock to be treated is directed towards reactor R1 then reactor R2 and finally reactor R3.

The diameter of each additional fixed or removable section will be adapted to the hydrogenation unit and to the estimated production capacities. Moreover, each section, (a), (b1), (b2) and (c) will comprise valves allowing the opening or closing of the section according to needs.

The improvement of the process according to the invention thus allows maximum use at 100% saturation of the catalyst of reactor R1. The yield is thus optimal, unlike that of the standard sequence where the catalyst of reactor R1 must be replaced at 90% of maximum saturation in order to avoid the spillover of sulphur to the next reactor.

The dearomatization process according to the invention allows the use of reactor R2 as first reactor during the changing of the catalyst of reactor R1. Reactor R2 will therefore be in direct contact with the sulphur contained in the feedstocks to be treated for the production of hydrocarbon-containing fluids. The catalyst of reactor R2 according to the invention will also need to be changed at 100% saturation. The standard hydrogenation catalysts can comprise the following metals: nickel, platinum, palladium, rhenium, rhodium, nickel tungstate, nickel-molybdenum, molybdenum, cobalt molybdate, nickel molybdate on silica and/or alumina supports or on zeolites. A preferred catalyst is an Ni-based catalyst on an alumina support the specific surface area of which varies between 100 and 200 m2/g of catalyst.

The standard hydrogenation conditions are as follows:

- Pressure: 50 to 160 bar, preferably 100 to 150 bar and more preferably 110 to 120 bar
- Temperature: 80 to 180° C., preferably 120 to 160° C. and more preferably 130 to 150° C.
- Liquid hourly space velocity (LHSV): 0.2 to 5 h-1, preferably 0.5 to 3 and more preferably 0.8 to 2
- Rate of hydrogen treatment: 50 to 300 Nm3/tonne of feedstock, preferably 80 to 250 and more preferably 100 to 200.

Essentially no previous hydrodesulphurization of the feedstock takes place beforehand: the sulphur-containing compounds are trapped by the catalyst rather than being released in the form of H2S. Under these conditions, the aromatics content of the final product will remain very low, typically less than 100 ppm, even if its boiling point is high (typically greater than 300° C. or even greater than 320° C.).

It is possible to use a reactor which comprises two or three catalytic beds or more. The catalysts can be present in quantities that are variable or essentially equal in each reactor; for three reactors, the quantities as a function of the weight can for example be 0.05-0.5/0.10-0.70/0.25-0.85. preferably 0.07-0.25/0.15-0.35/0.4-0.78 and more preferentially 0.10-0.20/0.20-0.32/0.48-0.70. It may be necessary to introduce quench boxes (for quenching the reaction) into the recycling system in order to cool the effluents from one reactor or from one catalytic bed to another in order to control the reaction temperatures and therefore the hydrothermal equilibrium of the hydrogenation reaction.

In an embodiment, at least part of the product obtained and/or the gases separated are recycled in the system for feeding the hydrogenation stages. This dilution contributes to maintaining the exothermicity of the reaction within controlled limits, in particular in the first stage. The recycling also allows an exchange of heat before the reaction and also better temperature control.

The effluent from the hydrogenation unit contains the hydrogenated product and hydrogen. Flash separators are used in order to separate the effluents into a gaseous phase, mainly the residual hydrogen, and a liquid phase, mainly the hydrogenated hydrocarbons. The process can be carried out using three flash separators, one high pressure, one intermediate pressure and one low pressure, very close to atmospheric pressure. The gaseous hydrogen which is collected at the top of the flash separators can be recycled in the hydrogenation unit feed system or at different levels in the hydrogenation units between the reactors.

According to the invention, the final separated product is at atmospheric pressure. It then directly feeds the vacuum fractionation unit. Preferably, the fractionation will take place at a pressure comprised between 10 and 50 mbar and more preferentially at approximately 30 mbar. The fractionation can be carried out in such a way that it is simultaneously possible for various hydrocarbon-containing fluids to be removed from the fractionation column and for their boiling point to be predetermined.

The hydrogenation reactors, the separators and the fractionation unit can therefore be directly connected without it being necessary to use intermediate tanks, which is usually the case. This integration of the hydrogenation and the fractionation allows optimized heat integration associated with a reduction in the number of pieces of equipment and with energy saving.

According to the process according to the invention, the petroleum cut used as feedstock is a refinery type petroleum cut which may originate from a distillates hydrocracking unit and can also comprise high aromatics contents such as a conventional Diesel with an ultra-low sulphur content, a heavy Diesel or an aviation fuel. The refinery petroleum cut can optionally undergo hydrocracking in order to obtain shorter and simpler molecules by the addition of hydrogen under high pressure in the presence of a catalyst. Descriptions of hydrocracking processes are provided in Hydrocarbon Processing (November 1996, pages 124 to 128), in Hydrocracking Science and Technology (1996) and in the patents U.S. Pat. No. 4,347,124, U.S. Pat. No. 4,447,315 and WO-A-99/47626.

A petroleum cut preferred as a refinery petroleum cut according to the invention is a hydrocracked gasoil cut originating from vacuum distillation. The optionally hydrocracked refinery petroleum cut can also be mixed with a hydrocarbon-containing cut originating from a gas to liquid (GTL) conversion process and/or gaseous condensates and/or a hydrodeoxygenated hydrocarbon cut obtained from biomass. Ideally, and in accordance with to the process according to the invention the petroleum cut, in a mixture or not, contains less than 15 ppm of sulphur, preferably less than 8 ppm and more preferentially less than 5 ppm (according to the standard EN ISO 20846) and less than 70% by weight of aromatics, preferably less than 50% by weight and more preferentially less than 30% by weight (according to the standard IP391 or EN 12916) and has a density less than 0.830 g/cm3 (according to the standard EN ISO 12185).

The fluids produced according to the process of the invention have a boiling range comprised between 100 and 400° C. and have a very low aromatics content generally less than 300 ppm, preferably less than 100 ppm and more preferentially less than 50 ppm. The fluids produced according to the process of the invention also have an extremely low sulphur content, less than 5 ppm, preferably less than 3 ppm and more preferentially less than 0.5 ppm, at a level too low to be detectable by means of conventional analyzers that are capable of measuring very low sulphur contents. The fluids produced according to the process of the invention also have:

- a naphthenes content less than 60% by weight, in particular less than 50% or even less than 40% and/or
- a polynaphthenes content less than 30% by weight, in particular less than 25% or even less than 20% and/or
- a paraffins content greater than 40% by weight, in particular greater than 60% or even greater than 70% and/or
- a isoparaffins content greater than 20% by weight, in particular greater than 30% or even greater than 40%.

The fluids produced according to the process of the invention have remarkable properties in terms of aniline point or solvent power, molecular weight, vapour pressure, viscosity, and evaporation conditions defined for systems for which drying is important and of defined surface tension. The fluids produced according to the process of the invention can be used as drilling liquids, as industrial solvents, in coating fluids, for metal extraction, in the mining industry, in explosives, in mould release formulations for concrete, in adhesives, in printing inks, for metal working, as rolling oils, as electroerosion machining liquids, as anti-rust agents in industrial lubricants, as dilution oils, in sealing products or polymer formulations based on silicone, as viscosity reducers in formulations based on plasticized polyvinyl chloride, in resins, in phytosanitary formulations for crop protection, in pharmaceutical products, in paint compositions, in polymers used in water treatment, in paper manufacture or in printing pastes or also as cleaning solvents.

Example

In the remainder of the present description, examples are given by way of illustration of the present invention and are in no way intended to limit the scope. The diagram of FIG. 9 shows a comparison between a normal system of hydrogenation reactors in series and the optimized system according to the invention during the changing of the catalyst of reactor R1 then of the catalyst of reactor R2. For the purpose of the present comparison, it is considered that the 3 reactors of the hydrodearomatization unit have a volume equal to 110 m3 with a volume of catalyst equal to 25 m3 for reactor R1 and equal to 35m3 for reactor R2.

According to this diagram, it is noted that 221 hours i.e. approximately 9 days are necessary for the operations of changing the catalyst of reactor R1 and 245 hours, i.e. approximately 10 days for the changing of the catalyst of reactor R2. This time is longer for the changing of the catalyst of reactor R2 than for that of reactor R1 as the volume of the catalyst of R2 is greater. The time necessary for changing the catalyst of reactor R1 in an optimized dearomatization unit configuration is the same as that of a normal configuration, i.e. approximately 9 days. However, the optimized configuration of reactors R1 and R2 of the dearomatization unit according to the invention makes it possible to continue the production of hydrocarbon-containing fluids during the changing of the catalysts of reactors R1 and R2, unlike a normal configuration. Furthermore, the catalysts of reactors R1 and R2 in the optimized configuration according to the invention are changed at 100% saturation, unlike a normal configuration with which it is necessary to change the catalyst at 90% saturation in order avoid the spillover of sulphur to the next reactor.

The invention claimed is:

1. A process for continuous dearomatization of a petroleum cut, comprising:

(a) producing a hydrocarbon-containing fluid with a very low sulphur content and very low aromatic compounds content, at least one stage of catalytic hydrogenation at a temperature comprised between 80 and 180° C. and at a pressure comprised between 50 and 160 bar, and the stage of catalytic hydrogenation is made up of several interchangeable reactors linked in series;

(b) isolating one of the reactors;

(c) feeding a first one of two non-isolated reactors with the petroleum cut and feeding a second non-isolated reactor with effluent from the first non-isolated reactor;

(d) regenerating the isolated reactor by replacement of the catalyst;

(e) interrupting the feeding the second non-isolated reactor with effluent from the first non-isolated reactor; and (f) feeding the regenerated reactor with the effluent from the first non-isolated reactors of stage (c) and feeding the second non-isolated reactor of stage (c) with the effluent from the regenerated reactor.

2. The process according to claim 1, wherein the several interchangeable reactors of the stage of catalytic hydrogenation comprises three interchangeable reactors linked in series, each comprising at least one catalyst.

3. The process according to claim 1, wherein first and second reactors, of the several interchangeable reactors, can be isolated in turn.

4. The process according to claim 1, further comprising catalysts of the first and second reactors, of the several interchangeable reactors, being changed without prolonged interruption of the production of the hydrocarbon-containing fluids.

5. The process according to claim 1, wherein the reactors in series are linked by fixed additional connections making it possible to isolate one of the reactors.

6. The process according to claim 1, wherein the reactors in series are linked by removable additional connections making it possible to isolate one of the reactors.

7. The process according to claim 1, wherein the reactors comprise catalysts, the catalysts of the reactors being changed at 100% saturation.

8. The process according to claim 1, wherein a rate of hydrogenation is comprised between 50 and 300 $Nm^3$/tonne of petroleum cut.

9. The process according to claim 2, wherein a quantity by weight of catalyst in each of the reactors is 0.05-0.5/0.10-0.70/0.25-0.85.

10. The process according to claim 9, wherein the quantity by weight of catalyst in each of the reactors is 0.07-0.25/0.15-0.35/0.4-0.78.

11. The process according to claim 1, comprising the stages of:

(b) isolating the first reactor in series;

(c) feeding the second reactor in series with the petroleum cut and feeding a third reactor in series with the effluent from the second reactor;

(d) replacing the catalyst of the first reactor;

(e) interrupting the feeding the third reactor in series with the effluent from the second reactor; and (f) feeding the first reactor with the effluent from the second reactor and feeding the third reactor with the effluent from the first reactor.

12. The process according to claim 1, comprising the stages of:

(b) isolating the second reactor in series;

(c) feeding the first reactor in series with the petroleum cut and feeding a third reactor in series with the effluent from the first reactor;

(d) replacing the catalyst of the second reactor;

(e) interrupting the feeding the third reactor in series with the effluent from the first reactor; and (f) feeding the second reactor with the effluent from the first reactor and feeding the third reactor with the effluent from the second reactor.

* * * * *